US006997254B2

(12) United States Patent
Jenner

(10) Patent No.: US 6,997,254 B2
(45) Date of Patent: Feb. 14, 2006

(54) METHOD OF MAKING A CENTERING DEVICE AND CENTERING DEVICE FORMED BY THAT METHOD

(75) Inventor: Andrew Jenner, Vechta (DE)

(73) Assignee: Domain Licences Limited, Tortola (VG)

( * ) Notice: Subject to any disclaimer, the term of this patent is extended or adjusted under 35 U.S.C. 154(b) by 238 days.

(21) Appl. No.: 10/102,379

(22) Filed: Mar. 19, 2002

(65) Prior Publication Data

US 2003/0000607 A1 Jan. 2, 2003

(30) Foreign Application Priority Data

Jun. 27, 2001 (GB) ..... 0115704

(51) Int. Cl.
*E21B 17/10* (2006.01)
*B23P 15/16* (2006.01)

(52) U.S. Cl. ..... 166/241.6; 166/241.7; 175/325.5; 175/325.6; 29/896.6

(58) Field of Classification Search ..... 166/241.1, 166/241.6, 241.7, 213, 172; 29/896.6; 175/325.5, 175/325.6
See application file for complete search history.

(56) References Cited

U.S. PATENT DOCUMENTS

| | | | | |
|---|---|---|---|---|
| 1,475,344 | A * | 11/1923 | Judson | 74/490 |
| 3,312,285 | A | 4/1967 | Solum | |
| 3,379,258 | A * | 4/1968 | Turbyfill | 166/241.7 |
| 3,578,084 | A | 5/1971 | Bombardieri et al. | |
| 4,575,912 | A | 3/1986 | Grip et al. | |
| 5,536,145 | A * | 7/1996 | Vandendriessche | 416/213 R |
| 5,899,052 | A * | 5/1999 | Turner | 56/255 |
| 6,102,118 | A | 8/2000 | Moore | |
| 6,571,452 | B1 * | 6/2003 | Wang | 29/557 |

FOREIGN PATENT DOCUMENTS

WO WO 99/25949 5/1999

* cited by examiner

*Primary Examiner*—Frank S. Tsay
*Assistant Examiner*—Giovanna M. Collins
(74) *Attorney, Agent, or Firm*—Hamilton, Brook, Smith & Reynolds, P.C.

(57) ABSTRACT

A spring centralizer device for supporting a tubular member spaced from the wall of a bore is made from a single piece of boron steel material. The spring centralizer device has first and second collars spaced apart along a longitudinal axis. Spring bow portions extend between the collars. As the device is made from a single piece of material, the material extends seamlessly from each collar portion through the bow portions so that there are no joins or points of weakness. Use of boron steel means that the device can be made by cold forming.

18 Claims, 13 Drawing Sheets

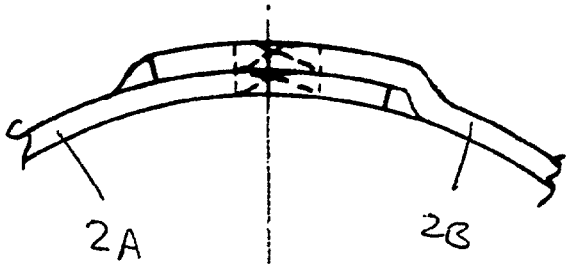
Fig. 28
Fig 29
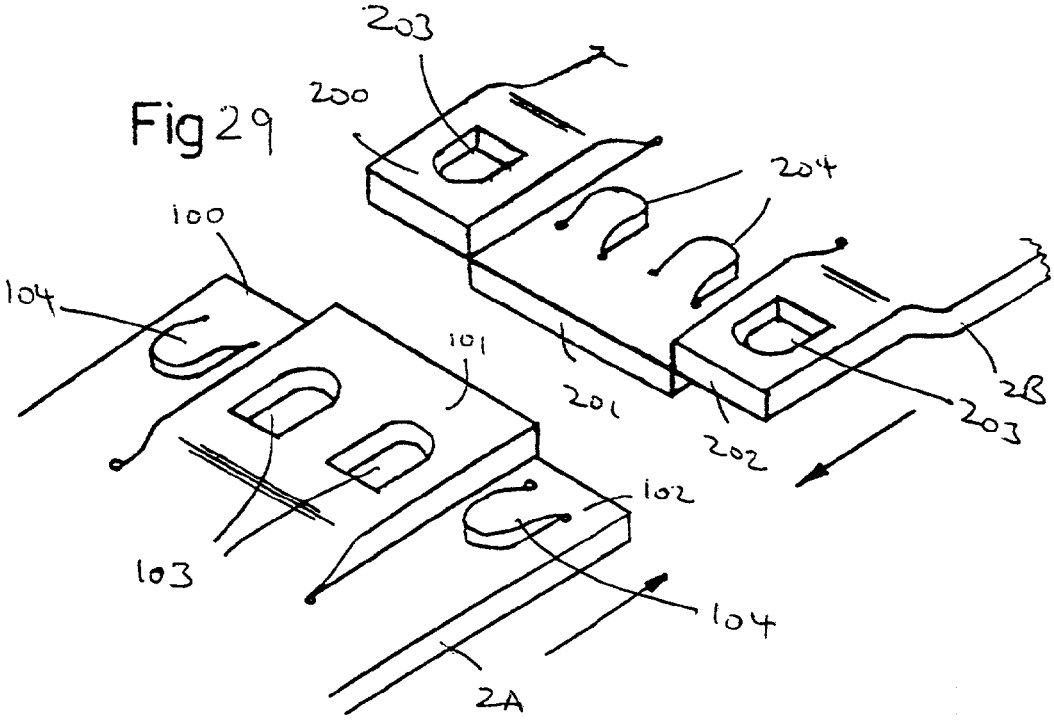

METHOD OF MAKING A CENTERING DEVICE AND CENTERING DEVICE FORMED BY THAT METHOD

FIELD OF THE INVENTION

The present invention relates to a spring centraliser device of the type for maintaining a tubular member spaced from the wall of a bore and to a method of making such a device. Such devices may also be used to space a tubular member within an existing tubular member.

BACKGROUND OF THE INVENTION

As known to those skilled in the art, centralisers are used in the oil, gas & water well drilling industries to center a tubular member (hereinafter referred to as a "tubular") within a borehole or inside a previously installed larger tubular member.

Such tubulars are generally constructed in handleable lengths e.g. 12 meters, each length being externally male threaded at both ends. The lengths are assembled together using short female threaded couplings. The assembly of the tubulars to a predetermined total length is referred to as a string.

When the string is disposed in a borehole or existing tubular, it is desirable to position the string substantially centrally within the borehole or existing tubular thereby forming a substantially annular passageway around the tubular of concern. This enables passage of material such as fluids, cement slurries in the space around the tubular. Under some circumstances substantial centrality is imperative.

To try to achieve this condition, centralisers are disposed at selected intervals along the length of the string. Retention of the centralisers in a desired position may be achieved in restricting axial movement by the use of a so-called "stop collar" being a ring grippingly secured to the tubular.

The state of the art embraces solid and spring centralisers. Solid (or rigid) centralisers are commonly cast products of a fixed dimensional construction with an undersize external diameter to allow passage through the borehole. Spring centralisers are of a flexible external diameter aimed at making contact with the borehole wall at all times while being capable of flexing to accommodate obstructions or dimensional changes within the borehole.

Solid centralisers have an internal diameter with clearance to fit onto a tubular and an external diameter selected to pass into the borehole of concern. Given the axial variation of diameter of the borehole it is clear that solid centralisers cannot adequately support the tubular in a central position. Equally being solid, a solid centraliser risks jamming within the borehole.

Spring centralisers may overcome these problems. The current design is a number of hardened and tempered leaf springs, also referred to in the art as bows, located radially around and affixed to low carbon steel end bands at both ends.

However spring centralisers currently in use exhibit difficulties with under modern conditions such as depth of well, angular deviation profile and extended horizontal reach into the hydrocarbon producing strata. As a result they may be made with an oversize outer diameter to create a pre-load effect that gives an acceptable deflection versus load characteristic: however this may create undesirable insertion forces. This in turn, together with multi-part construction gives rise to the possibility of disintegration.

Known methods of securing together of the parts of the conventional centraliser include welding and mechanical interlocking of the leaf springs to the end bands—both methods of construction detract from the maximum possible load/deflection performance.

The multiple parts used to construct conventional centralisers e.g. a split and hinged variety of a more common size variant consists of fourteen individual parts, each part being at risk of breaking off and falling into the well bore.

There is thus a long felt want for a practical one-piece centraliser.

U.S. Pat. No. 3,312,285 (Solum) contains a disclosure of a one-piece centraliser consisting of two collars spaced by bows (staves) which are outwardly curved and serve to centralize a tubular member. The Patent further discloses a manufacturing technique for such a centraliser.

The manufacturing method consists of cutting a blank from a sheet of metal material by cutting or punching. The material is said to be a steel selected from a group including "plain carbon steels with a relatively high carbon content or alloy steels with a medium carbon content". The Patent specifically envisages the use of "grades of steel . . . which are unsatisfactory for construction of centralisers using conventional methods due to such factors as the need for welding the spring bows to the end collars". It is understood that such materials are spring, non-ductile, steels.

The manufacturing method requires the blank to be placed on a forming die having a semi-cylindrical cavity, followed by application of a press tool to form the blank into a U-shape and in turn followed by the application of an inverse die to form a "long cylinder".

The blank is then supported at one end and the other end urged towards the one end to provide outwardly-bowed staves as required.

Finally the abutting ends of the blank are welded together by arc-welding to create a generally cylindrical centraliser.

The centraliser is then heat-treated to obtain the desired hardness.

Experiments have revealed a number of deficiencies in the technique described in U.S. Pat. No. 3,312,285. Indeed the disclosure of the U.S. patent is not believed to provide a practical method for manufacturing a centraliser. Further a device which is manufactured from material to which the method of the Patent can be applied is not believed to have the desired properties of a practical centraliser.

Firstly it is noted that the use of a cold-forming dual die system of the type disclosed in the Patent upon a spring steel would not result in a cylindrical blank. Rather, the ends of the blank which were brought into abutment by the die, would spring apart once the die were removed. It would, therefore, be necessary either to perform the forming step as a hot forming process or alternatively to physically restrain the blank in its cylindrical state. The latter technique would not permit the outward-bowing step as disclosed in the patent.

Forming the blank into a generally cylindrical body by the die technique disclosed has been found to give rise to curved end collar portions. However, the intermediate bow portions, which are separated by longitudinal apertures, do not confirm to the curved profile of the collar portions due to the presence of the apertures. The bow portions, therefore, tend to form flats, or curves of relatively unpredictable curvatures.

During longitudinal bow-forming pressure, the bows neither form uniformly nor predictably. Furthermore, unless hot forming is used the tolerances in the bows are unacceptable. Moreover, as the material used is a spring steel, it is necessary to over-bend the bows and it is not possible to determine consistently how far to over bend the bows to give rise to a desired final form.

On the basis of the experiments performed, it has been found that a centraliser in accordance with U.S. Pat. No. 3,312,285 requires the use of hot forming. This in turn means the use of expensive high temperature form tools with the resultant high tooling attrition. At least two and maybe three heating steps are required for forming followed by a heating/quenching phase to the required hardness. Then a further heating to temper stage of around 450 degrees centigrade is required.

Apart from the high cost of hot forming in this way, there is the risk of growth of grain within the crystalline structure of the material, which would give rise to weakness and the risk of breakage. Further, each of the heating steps is likely to give rise to distortion, which reduces the yield and increases the cost.

It is known that the form of the bows is desirably parabolic in the longitudinal direction. The technique disclosed in U.S. Pat. No. 3,312,285 makes this form difficult to attain on a consistent basis. The arc-welding step requires pre-heating and a slow post-weld cooling.

It is therefore believed that the product and method of the U.S. patent is impractical. If conventional ductile formable materials were used, the method would be capable of putting into effect, but the resultant product would not have the properties required of a centraliser.

It is understood that products in accordance with U.S. Pat. No. 3,312,285 are not on the market.

OBJECT OF THE INVENTION

It is therefore an object of the invention to provide a spring centraliser device embodiments of which can be made by cold-forming and embodiments of which have the desirable properties of such centralisers.

SUMMARY OF THE INVENTION

According to one aspect of the invention there is provided a spring centraliser device for supporting a tubular member spaced from the wall of a bore, the spring centraliser device having a longitudinal axis, and the spring centraliser device comprising first and second mutually spaced collar portions and a plurality of bow portions disposed therebetween, wherein the first and second collar portions and the bow portions are formed from a single piece of boron steel material such that the material extends seamlessly from each collar portion through the bow portions.

In a first embodiment, each collar portion is substantially cylindrical, whereby said centraliser device extends all around said longitudinal axis.

In a second embodiment, each collar portion extends over a part of a cylinder, and includes a body portion and a securing device for attachment to a further collar portion of a contiguous centraliser device.

Preferably, each collar portion extends over a half of a cylinder, the device in combination with a second said centraliser device extending all around said longitudinal axis.

In one embodiment, said securing device comprises first and second counterpart hinge portions extending from opposing edge region of the body portion.

Advantageously, said hinge portions each define a respective aperture for a respective hinge pin, each aperture being disposed substantially parallel to said longitudinal axis, the hinge portions having at least one projecting finger portion extending from said edge region at a proximal region thereof, the or each finger portion having a distal region directed substantially towards said edge region and a region intermediate said proximal and distal regions, said intermediate describing a curved path, and a surface of said intermediate region defining at least in part, said aperture.

Conveniently the first hinge portion has a first plurality of first finger portions spaced apart in a direction parallel said axis to define a second plurality of openings, wherein said second plurality is one in number less than the second plurality, and the second hinge portion has said second plurality of finger portions for co-operation with a first hinge portion of a further device.

In another presently preferred embodiment, said securing device comprises a first formation in one securing region of said centraliser device and a second counterpart formation in an opposing securing region of said centraliser device, wherein the first formation of a first centraliser device is adapted to interlock with the second formation of a second centraliser device.

Preferably the first formation comprises at least one projection from a first face of said centraliser device, and at least one aperture in a second face, wherein the second face is opposite the first face, and the second formation comprises at least one aperture in said second face and at least one projection from the first face whereby the or each aperture is for receiving the respective projection, whereby two said centraliser devices may be form-locked together.

According to another aspect of the invention there is provided a method of making a centraliser device having a longitudinal axis, the method comprising:

providing a sheet of boron steel;

producing from said sheet a flat blank comprising a first and a second transverse web portion spaced apart by plural spaced longitudinal web portions;

cold-forming said blank to form a shaped intermediate product having a desired final device shape; and heating and quenching said shaped intermediate product to a desired finish hardness.

In one embodiment, said producing step comprises laser cutting the sheet.

In another embodiment, said producing step comprises water-jet cutting of the sheet.

Preferably said centraliser device is substantially semi-cylindrical, whereby said first and second transverse web portions extend to form substantially semi-cylindrical collar portions and wherein said collar portions have securing means for securing to collar portions of a second said centraliser device to form a substantially cylindrical centraliser, wherein said cold-forming step comprises forming at least part of said securing device.

Advantageously, said step of forming at least part of said securing device comprises forming a hooked portion of said collar portion.

Preferably, after said heating and quenching step the method further comprises disposing a hinge pin in abutment with the hooked portions of two contiguous centraliser devices to thereby hingedly secure the centraliser devices together.

In another embodiment, said step of forming at least part of said securing device comprises forming at one securing region of said centraliser device, at least one first region projection from a first face thereof, and at least one first region aperture in a second face thereof, and forming at a second opposing securing region, at least one second region aperture in said second face thereof at a location for cooperating with the at least one first region projection and at least one second region projection in said first face thereof at a location for cooperating with the at least one first region aperture.

In a preferred method, said cold-forming step comprises forming said longitudinal web portions into bow portions having central regions relatively further from the longitudinal axis of said centraliser device than end regions of said bow portions.

Advantageously, said bow forming step comprises forming said bow portions undersize, and the method further comprises, after said heating and quenching step, a further cold-forming step to form said bow portions to a desired final diameter.

The invention further relates to a stop collar of boron steel produced by welding.

In a preferred embodiment, swaging is used before heat treatment to provide end flanges.

Advantageously, flow-drilling techniques are used to provide boss portions for screw attachments.

BRIEF DESCRIPTION OF THE DRAWINGS

Exemplary preferred embodiments of the invention will now be described with reference to the accompanying drawings, in which:

FIG. 28 shows a partial end view of a two-part centraliser, having a snap-lock fastening;

FIG. 29 shows a perspective view of the snap lock fastening of FIG. 28;

DESCRIPTION OF THE PREFERRED EMBODIMENTS

In the various Figures, like reference signs indicate like parts.

Figure 1:
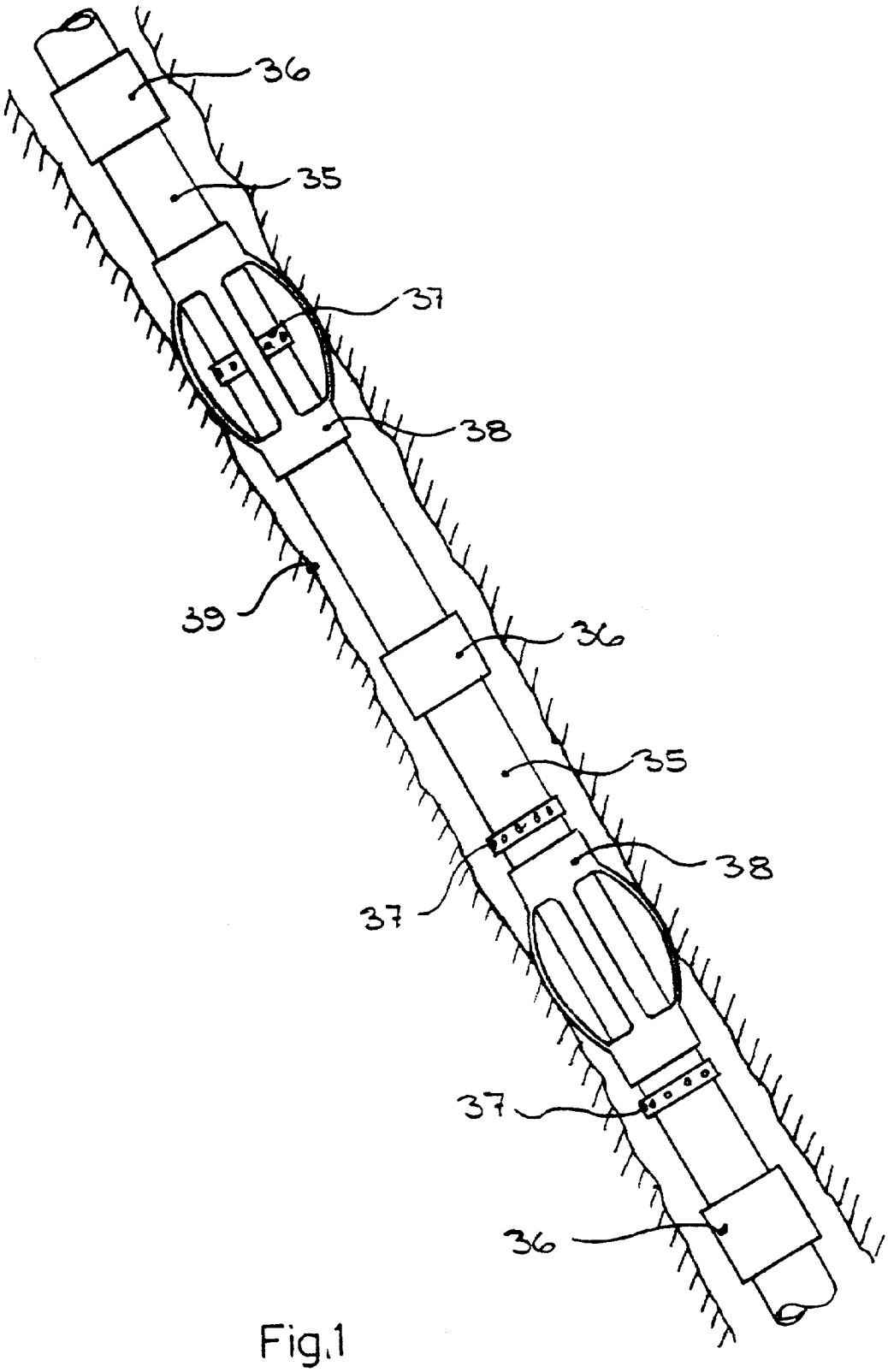
FIG. 1 shows schematically a typical arrangement of a tubular received and centralised within a borehole.

Referring to FIG. 1, a tubular disposed within a borehole 39 is formed from a plurality of lengths 35 connected together by couplings 36. As is well known, a centraliser 38 is supported on each length 35 by way of a respective stop collar 37. Each centraliser 38 is arranged to support the tubular, formed of the lengths 35, within the borehole 39 such that the tubular is substantially centrally arranged. Each centraliser 38 has a pair of opposed end collar portions with six (three visible) outwardly bowed spring portions linking the collar portions. The spring portions are disposed substantially equidistant around the circumferences of the collar portions. The projection of the spring portions on the tubular are all substantially straight lines in this embodiment.

It will be seen that the upper, as seen in the drawing, centraliser has a stop collar 37 disposed between the two end collars, whereas the lower centraliser is disposed between two spaced stop collars 37.

It will be understood that the need for centralisation is found not only in the borehole but is also experienced within the internal diameter of a previously installed larger tubular assembly.

Figure 2:
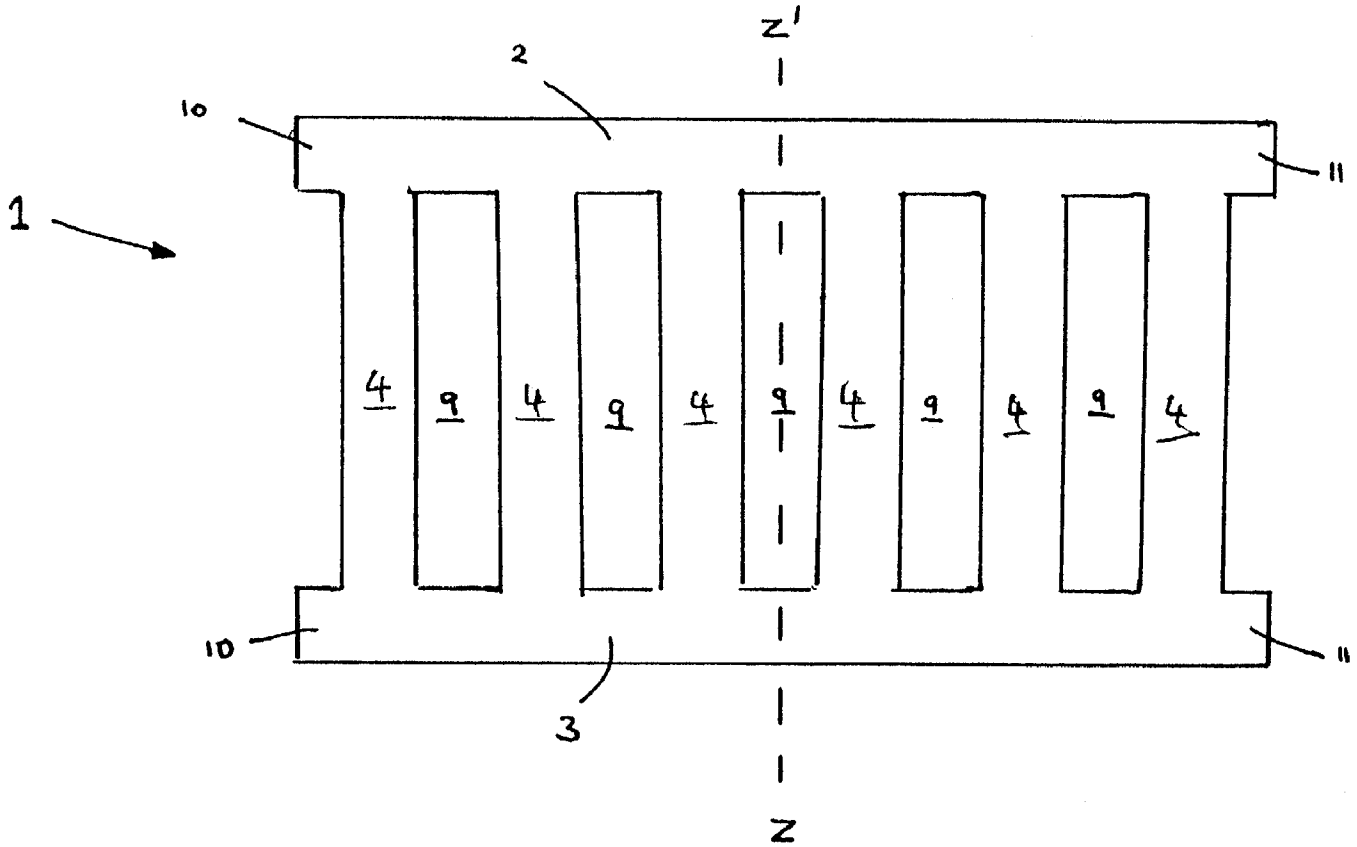
FIG. 2 is a plan view of a blank for forming a spring centraliser.

FIG. 2 shows a blank 1, which has been formed from a single sheet of boron steel. The blank has a longitudinal axis Z–Z' two transverse web portions 2, 3 spaced apart by a number, here six, of spaced longitudinal web portions 4 which extend substantially parallel (in this embodiment) to the axis Z–Z'. The first and second transverse web portions 2, 3 are generally rectangular in shape, are mutually parallel and are disposed substantially perpendicular to the axis Z–Z'. The six longitudinal web portions 4 extend between the transverse web portions 2,3 to define therebetween five apertures 9 of equal size. The outer longitudinal web portions 4 are inset from the ends of the transverse web portions by around half the width of the apertures 9 to leave free end portions 10,11 of the transverse web portions. The free end portions are, in a first embodiment of a centraliser overlappingly secured together so that each first end portion 10 overlaps its corresponding second end portion 11 whereby the centraliser forms a generally cylindrical device. In other embodiments, the length of the free end portions is greater, and in these embodiments the free end portions are subsequently formed into connecting devices, as will later be described herein.

It will, of course, be understood that this is a purely exemplary blank and is used here to illustrate the method of the invention.

The blank is formed by cutting or punching from the sheet. A preferred technique is a high accuracy computer-controllable cutting method such as laser cutting or waterjet cutting. Such a technique can allow great flexibility, for instance enabling 'specials' to be produced without a need for expensive dedicated tooling.

The blank is then cold-formed into a generally cylindrical shape. This may be accomplished by rolling or by other techniques known in themselves in the art.

The relatively ductile nature of the boron steel material forming the blank allows for the blank to remain in its cylindrical state after the forming has taken place.

The cylinder-forming stage preferably also forms the cross-sectional profile of the longitudinal web portions 4. As will be later described, this cross-sectional form may be curved or, under certain circumstances, other shapes such as a flat shape may be preferred.

It is also possible to shape the cross-sectional form of the longitudinal web portions after forming the cylindrical intermediate product.

Figure 3:
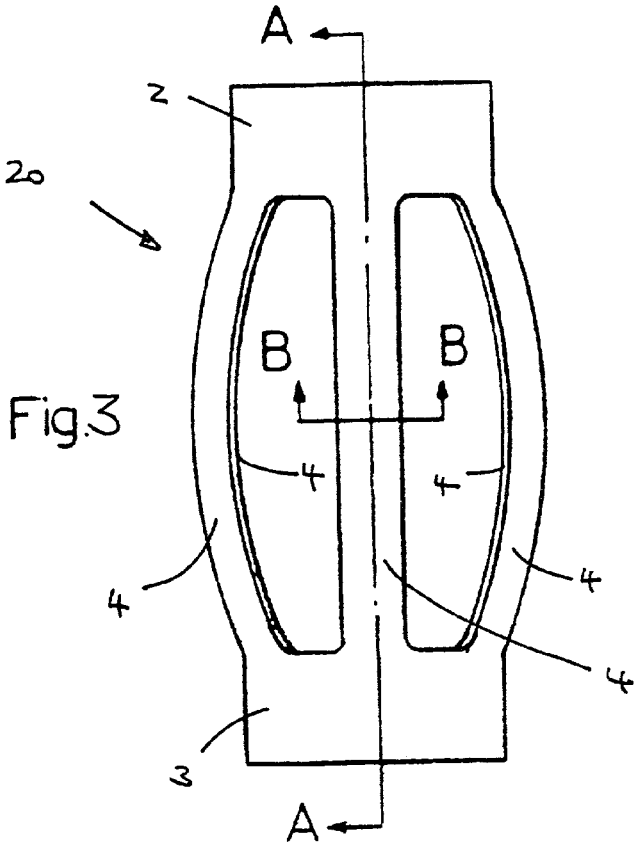
FIG. 3 is a side elevation of a spring centraliser formed from the blank of FIG. 2 and in accordance with the first embodiment of the invention.

Given the cylindrical intermediate product, the next step is to cold-form the longitudinal web portions to form the outwardly-curved bow portions (seen more clearly in FIG. 3). Again, given the relatively ductility of the material of the longitudinal web portions, it is possible to use an expanding mandrel or a similar device to achieve the desired form. The amount of "spring" is sufficiently small that desired profiles are easily obtained.

The present embodiment is then welded along the free end portions 10,11 to form a substantially continuous cylindrical member, albeit with the outwardly-curved bow portions 4, and then a single heat stage is required followed by quenching to provide the desired finished hardness of the centraliser.

If required, the device may then be stress-tempered. This tempering may be for the whole device, or localised heating of the bows may be instead performed. The heat required to temper boron steel is typically around 200° C., less than half of the temperature required to temper spring steel.

It will be seen that it is possible to form the centraliser of the invention entirely without heat, with a subsequent single heating step providing the desired finished hardness and an optional stress tempering stage at a lower temperature than that required for spring steel. The result is that cold-forming tools are used, which allows for long tooling life. As there is no need to constantly heat and cool the centraliser, there is no risk of gain growth due to multiple heating and both stress and increase and heat distortion are avoidable. Suitable techniques are available to fine-tune the cross-section of the bows. Cold-forming allows the ready and consistent forming of the longitudinal shape of the bows.

It has been found that the properties of steel as delivered may vary from sheet-to-sheet. Given the fact that after forming and heat-treating the properties become more known in a preferred embodiment the centraliser device is cold-formed so that the bows are undersized. The amount of undersize may be determined by experiment, but typically a reduction in diameter of about 12 millimeters may be desirable. After a cold-forming step, the device is heat-treated to provide the desired hardness and, if necessary, temper. Then a further cold-forming step is performed to post-form the bows to the final desired configuration.

It will be clear to those skilled in the art that this preferred method step ensures that the final product will be consistent. It will also be clear to those skilled in the art that cold-forming after heat-treatment further enhances the crystalline properties of the material.

In some embodiments of the invention the free-end portions 10 and 11 are formed into snap-lock securing devices. This has not normally been practical with spring centralisers because the end band materials tend to be ductile and as a result have limited yield strength. In situations where spring steel is proposed, high temperature forming would be needed, with consequential tooling problems, if such a joint were attempted. The use of boron steel does, however, provide more than adequate stiffness in the end band/collar to allow for the snap lock connection to be effected and is achieved by cold-forming.

In other embodiments of the invention, as will be later herein described, the free end portions 10 and 11 are shaped to form hinge-type securing devices. The use of boron steel allows for turning over of the ends of the transverse webs with internal radii below twice the material thickness. By the use of boron steel, it is possible to sharply turn the material with a radius less than the material thickness. This should be contrasted with spring steels where radii above twice the material thickness are required, and in which hot forming is required.

It is noted that boron steel is well suited to welding; however, various of the embodiments described herein contain snap-fastenings or hinged joints so that welding can be avoided.

Referring to FIG. 3, a completed centraliser 20 is shown. This centraliser, as will be clear from consideration of FIG. 2, has six bows. It will be clear to those skilled in the art that a number of bows will be selected to the application and typically varies between three and eighteen. It is also envisaged that more than eighteen bows could be needed in certain applications.

Figure 5:
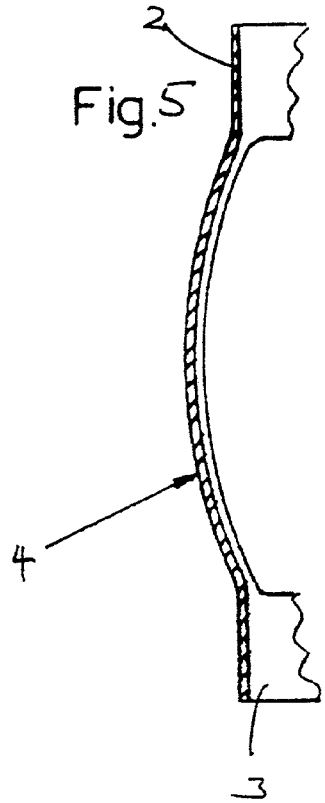
FIG. 5 is a sectional view along the line AA of the centraliser of FIG. 3.
Figure 4:
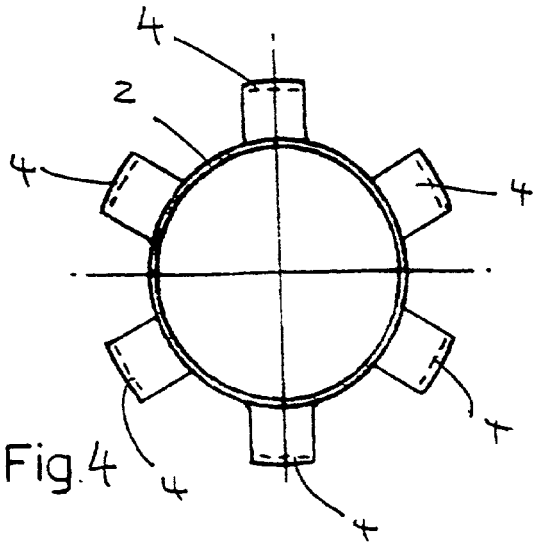
FIG. 4 is an end elevation of the centraliser of FIG. 3.

FIG. 4 shows an end view of the centraliser of FIG. 3. Referring to FIG. 5, the section A—A of FIG. 3 shows the curved form of the outer surface of the bow element 4. The particular shape of the bow element may be configured to obtain desired load-deflection characteristics. This is more fully discussed herein with reference to FIG. 12.

Figure 6:
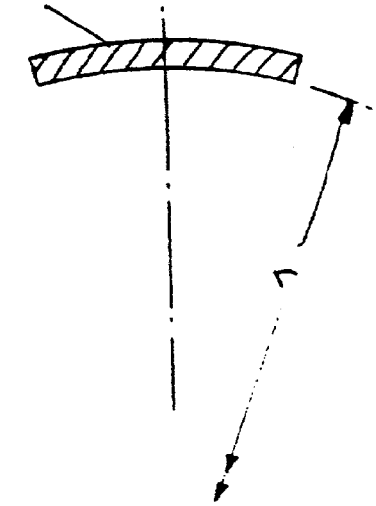
FIG. 6 is a sectional view along the line BB of the centraliser of FIG. 3.
Figure 7:
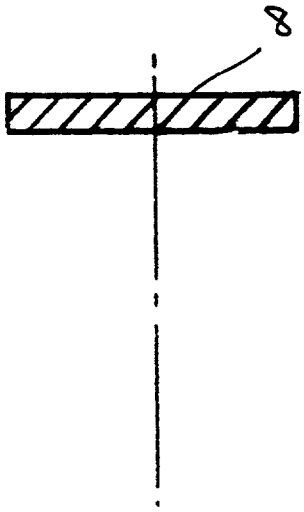
FIG. 7 is a sectional view along the line BB of an alternative centraliser to that shown in FIG. 3.

Referring to FIG. 6, the preferred shape of the cross-section of the bow element 4 is a curve. The particular shape shown in FIG. 6 is a sector of a circle, having radius r. By contrast, FIG. 7 shows an alternative bow element 8 having a flat cross-section, which is less preferred. A mathematical analysis to compare the stiffness of the sections can be performed, for example using the parallel axis theorem.

Consider an exemplary flat section having width 1.5 units and thickness 0.158 units. This is similar to the embodiment of FIG. 7, and has a second moment of area about the neutral axis, Ina given by equation 1:

$$I_{na}=0.0005^4 \quad (1)$$

Consider now a section having the same width and thickness but having a curvature of 3.56 units. This is similar to the embodiment of FIG. 6, and has a second moment of area about the neutral axis, Ina given by equation 2:

$$I_{na}=0.0006^4 \quad (2)$$

It is thus follows that in the above examples curvature of the cross-section shows some 20% increase in stiffness over the flat bar cross-section of similar proportions.

The cold-forming techniques made possible by the use of boron steel as the material of the centraliser provide an ability to adjust cross-sectional curvature. In turn, this facilitates fine-tuning of the flexive force resistance. Moreover, transition regions from the selected cross-sectional curve of the bows to the end collar portions can be shaped to maximise stiffness of the flexing construction.

It is also desirable in certain embodiments to form the bows to have a curvature greater than the curvature of a tubular to be inserted into the collar portions. In this case, each bow has an inner face which is shaped in the transverse direction such that a transversely middle region of the inner face is spaced from the longitudinal axis of the centraliser by a first amount, and the transverse edges of the bow are spaced from the longitudinal axis by a second amount, the first amount being greater than the second by more than the thickness of the material of the bow portions. This means that if the bow is compressed in use, the middle region is supported away from the tubular by the end portions abutting the tubular. The result is that the transition region where the bow merges with the collar is not permanently set by the compression, which would result in the centraliser becoming effectively useless.

Figure 8:
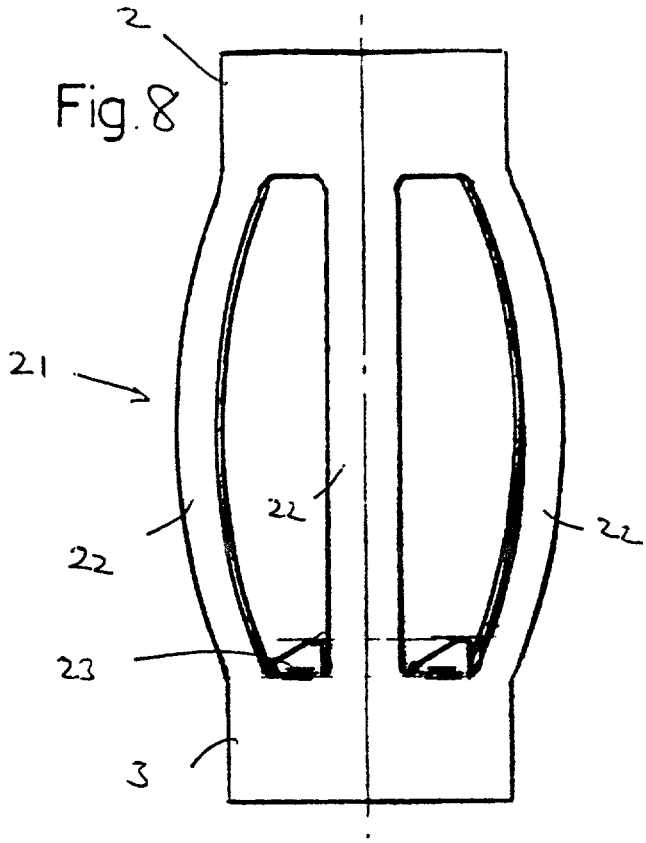
FIG. 8 is a side elevation of a spring centraliser in accordance with a second embodiment of the invention.
Figure 9:
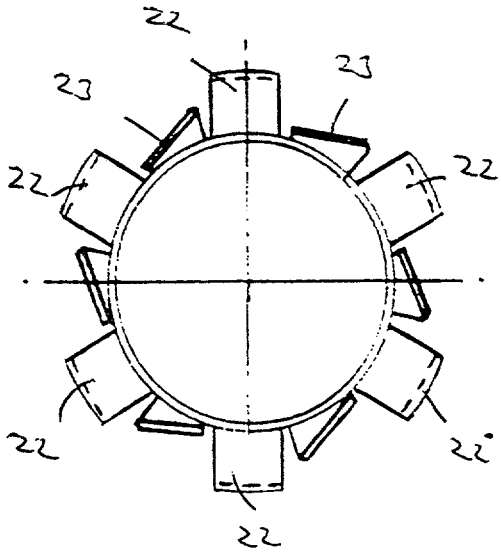
FIG. 9 is an end elevation of the centraliser of FIG. 8.

FIG. 8 shows a second embodiment of a centraliser in accordance with the present invention. The centraliser 21 is generally similar to that described with respect of FIG. 3 although it has six bow elements 22, uniformly distributed about its circumference (see FIG. 9). Additionally, however, they are formed at the lower end showed in the Figure of the centraliser, small "tangs" 23 extending angularly outwards from the lower collar portion 3. The tangs protrude into the annulus formed between the tubular being centralized and the borehole and have the effect of producing turbulence in fluid passing through the annulus. The tangs are integrally formed with the centraliser. It will be understood by those skilled in the art that tangs may be provided at both ends of the centraliser if desired.

Figure 10:
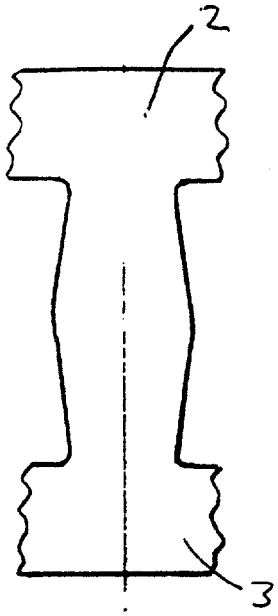
FIG. 10 shows a first configuration of spring portion for use in centralisers of the invention.

Referring to FIG. 10, an embodiment of the centraliser blank is shown in which the longitudinal web portions are shaped to have a reduced width where they extend into the end collars 2 and 3. A centraliser of this embodiment may be used where the highest load needs to be limited at maximum deflection. Conversely, referring to FIG. 11, an embodiment is shown where the transverse width of the bow element is increased where it extends into the collar portions 2 and 3. Such a configuration may be used where a higher load is acceptable at a maximum deflection.

Figure 12:
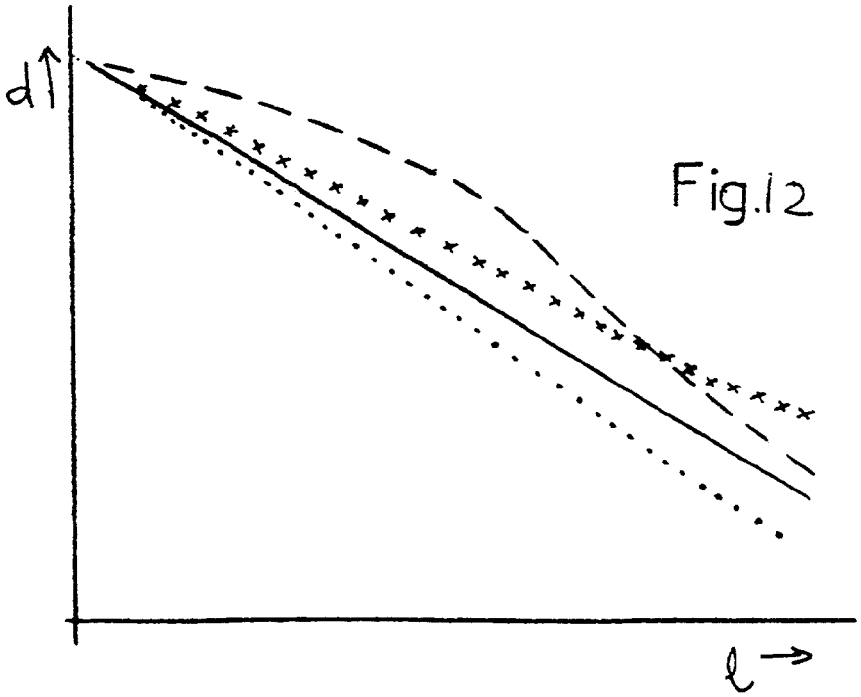
FIG. 12 is a graph plotting deflection against load for different spring configurations.

Referring to FIG. 12, a graphical representation of deflection (d) versus load (l) has a first full-line curve for the embodiment of FIGS. 2–6. Where a parabolic form of bow is provided, the dashed-line curve characteristic arises. A force perpendicular to the axis of the tubular applied to the leaf spring, would meet at the onset of deflection a parabolic form. The load is resisted to a greater degree by the parabolic form until the form is deformed to a curvature similar to that of a conventional radius. This is a preferred effect, which would be especially desired where a spring centraliser has been made to be a slide or push fit into the borehole.

Figure 11:
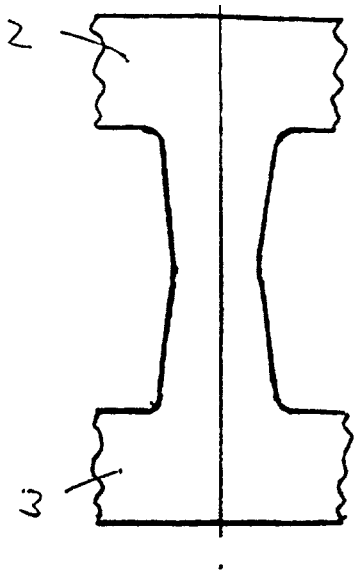
FIG. 11 is shows a second configuration of spring portion for use in centralisers of the invention.

The dotted curve conforms to a reduced end-width bow form, as exemplified in FIG. 10, and the crossed curve relates to an increased end-width bow form as exemplified in FIG. 11.

Figure 13:
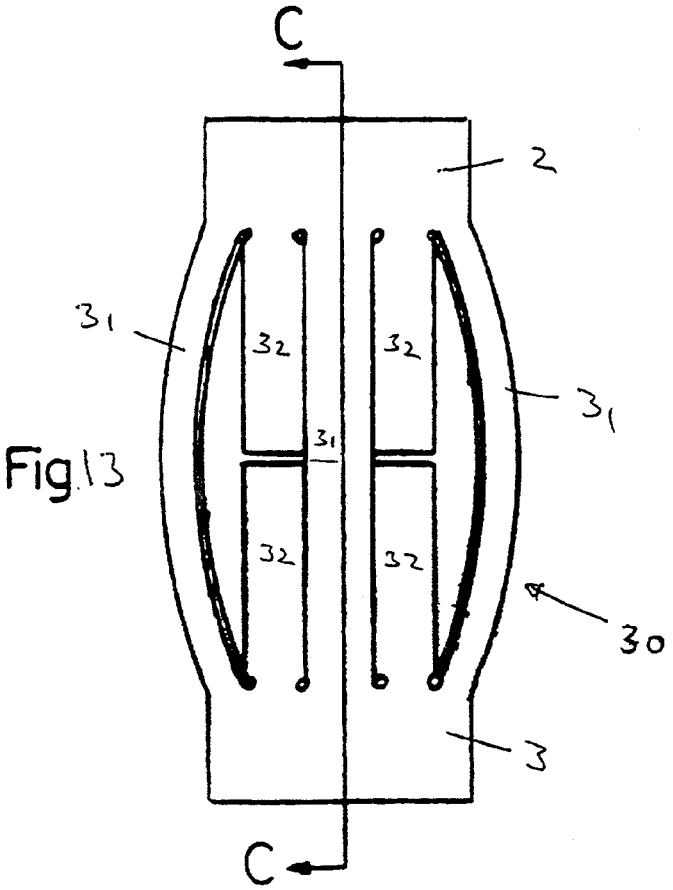
FIG. 13 is a side elevation of a spring centraliser in accordance with a third embodiment of the invention.

Referring now to FIG. 13, in a further series of embodiments, the bow members are not separated by apertures but instead by narrow slots, the material forming the lands 32 between the slots being retained. The lands 32 are not curved at the time of forming the bow element 31. However, the lands are separated in the longitudinal direction by a transverse slot so as to provide land portions 32 extending downwardly from the upper collar portion 2 and land portions extending upwardly from the lower collar portion 3. The gap between the lands is selectable as best seen in FIGS. 14–16.

Figure 14:
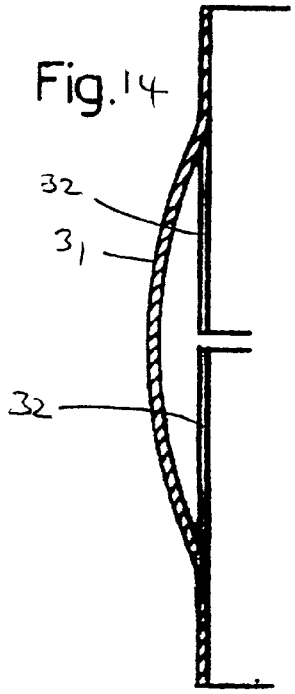
FIG. 14 is a sectional view along the line CC of the centraliser of FIG. 13.

In FIG. 14 the gap between the upper and lower land portions 32 is relatively small. Such an embodiment has advantages under certain circumstances. When a centraliser on a tubular is being run into a borehole, it is possible for the centraliser to catch or snag against, for instance, a protrusion of the borehole. Given that the centralisers are axially restrained by stop collars on the tubular—see 37 in FIG. 1—there is a chance that with the substantial weight of tubular involved, the centraliser may be axially compressed. In such a situation the bows can be distorted outwardly beyond the yield of the material and become permanently set in oversize condition. The embodiment shown in FIG. 14 uses the spacing between the land portions 32 to limit the reduction in centraliser free height to prevent such a condition arising.

Figure 15:
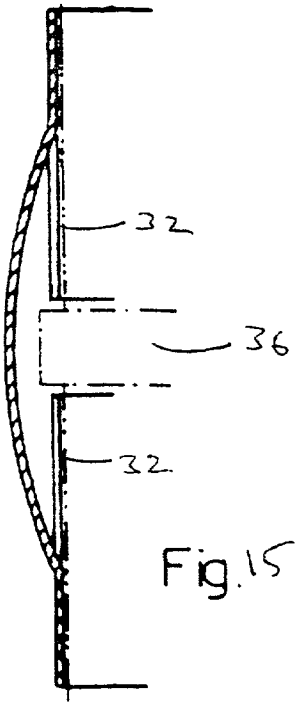
FIG. 15 is a view similar to that of FIG. 14 of a first modification of the embodiment of FIG. 13.
Figure 16:
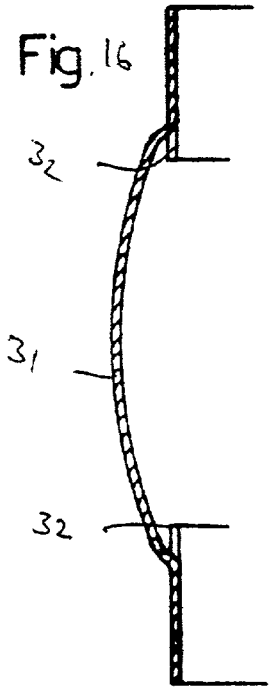
FIG. 16 is a view similar to that of FIG. 14 of a second modification of the embodiment of FIG. 13.

Referring to FIG. 15, the spacing between the land portions is greater than that shown in FIG. 14 and is sufficient to enable a stop collar to be positioned on the tubular and within the body of the centraliser. A further embodiment shown in FIG. 16 has a substantial spacing between the land portions, and in this case where a stop collar is introduced within the body of the centraliser and increased axial movement between the centraliser and stop collar is allowed.

Figure 17:
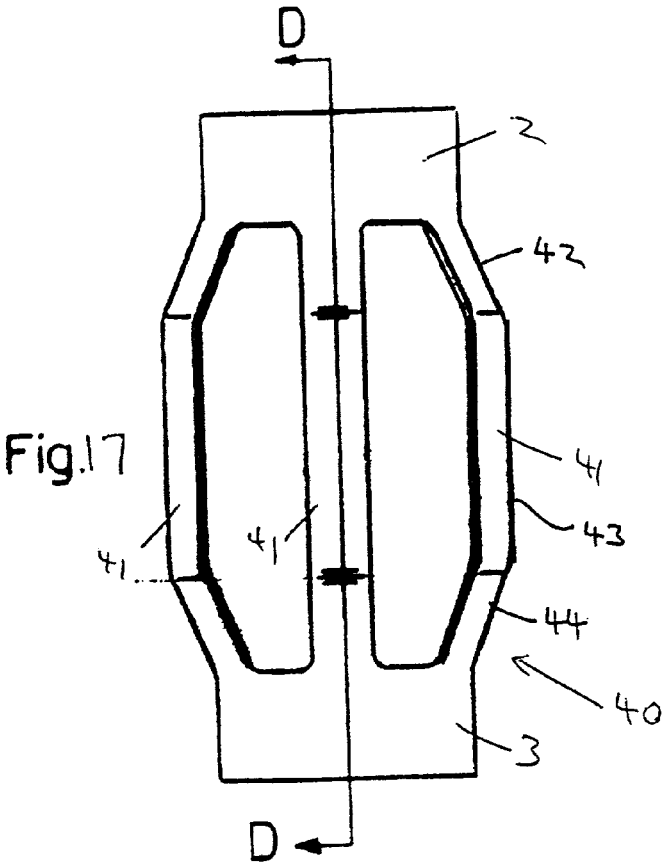
FIG. 17 is a side elevation of a spring centraliser in accordance with a fourth embodiment of the invention, having spring portions formed from generally straight line segments.
Figure 18:
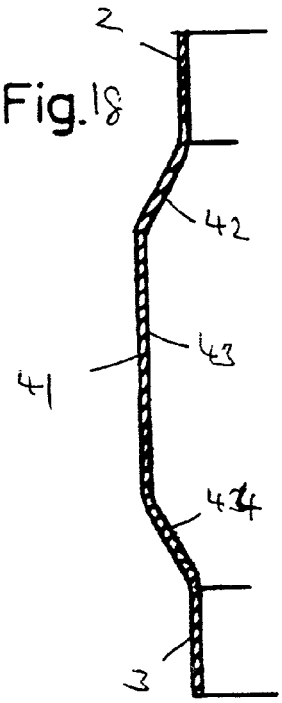
FIG. 18 is a sectional view along the line DD of the centraliser of FIG. 17.

Referring to FIGS. 17 and 18, in a fourth embodiment of the centraliser 40, the form of the bow elements 41 (best seen with reference to FIG. 18) is generally flat.

Continuing to refer to FIGS. 17 and 18, each bow element 41 has a first substantially straight portion 42 extending downwardly from the first collar portion 2 and laterally away from the longitudinal axis, followed by a second portion 44 which is substantially axis parallel and a third straight line 43 which tapers back to extend into the lower collar at portion 3.

Figure 19:
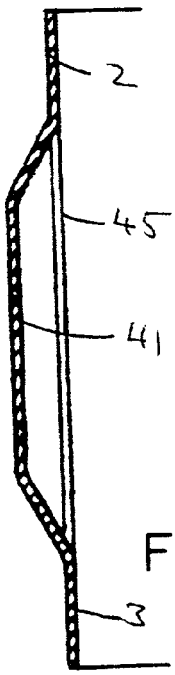
FIG. 19 is a view similar to that of FIG. 18 of a first modification of the fourth embodiment of the invention.
Figure 20:
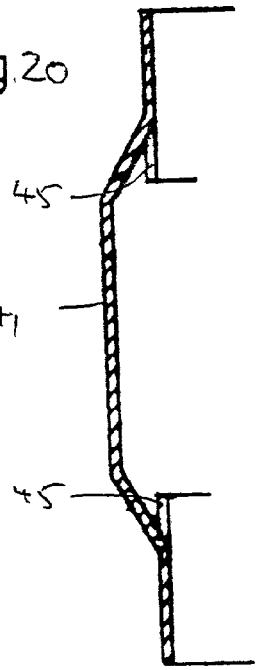
FIG. 20 is a view similar to that of FIG. 18 of a second modification of the fourth embodiment of the invention.

The fourth embodiment has very rigid properties. Very high loads would be required to deflect the bows and, once the material yield point had been exceeded, there would be virtually no spring recovery. Such rigid centralisers would be made undersize to the borehole, typically six millimeters or more less than the borehole diameter. They might be employed where there was the expectation of high lateral loads of greater magnitude than the restoring force of the centraliser. A modification of the fourth embodiment is shown in FIG. 19 in which land material 45 is retained and extends fully between the upper and lower collar portions 2 and 3. This embodiment provides high longitudinal strength to resist height collapse if the centraliser should snag when running into the borehole. Yet a further modification is shown in FIG. 20 in which the land material is removed in a similar way to that described with respect to FIG. 16.

Figure 21:
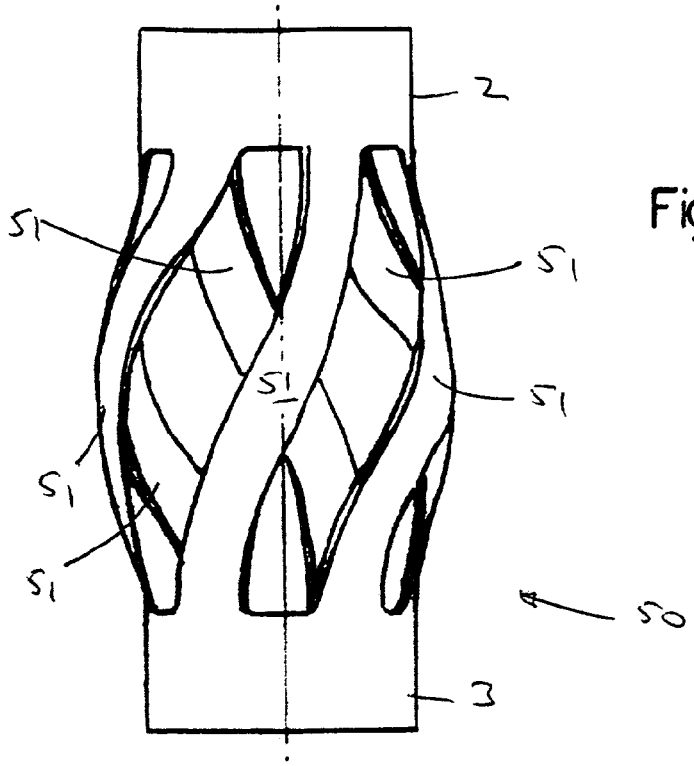
FIG. 21 is a side elevation of a spring centraliser in accordance with a fourth embodiment of the invention, having spirally-formed spring portions.
Figure 22:
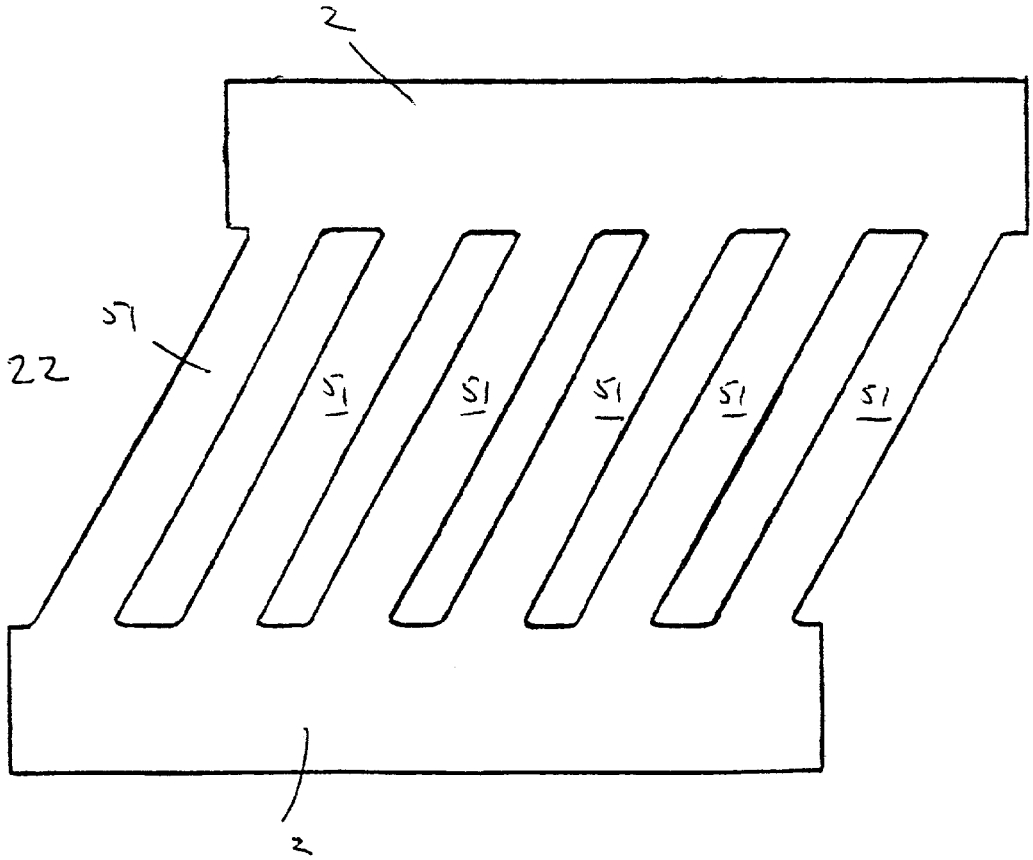
FIG. 22 is a plan view of a blank for forming the centraliser of FIG. 21.

Referring to FIG. 21, a further embodiment of a centraliser in accordance with the invention is shown, in which the bow portions 51 of the centraliser 50 describe a generally spiral path between the upper and lower collar portions 2 and 3. FIG. 22 shows a blank used for the embodiment of FIG. 21.

Figure 24:
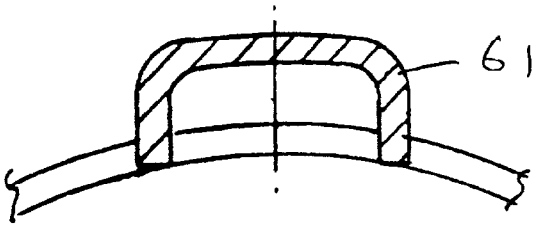
FIG. 24 is a sectional view across a first configuration of spring portion of the embodiments shown in FIGS. 17 and 23.
Figure 25:
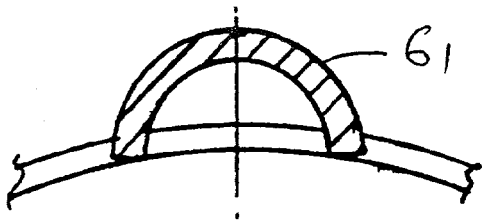
FIG. 25 is a sectional view across a second configuration of spring portion of the embodiments shown in FIGS. 17 and 23.
Figure 23:
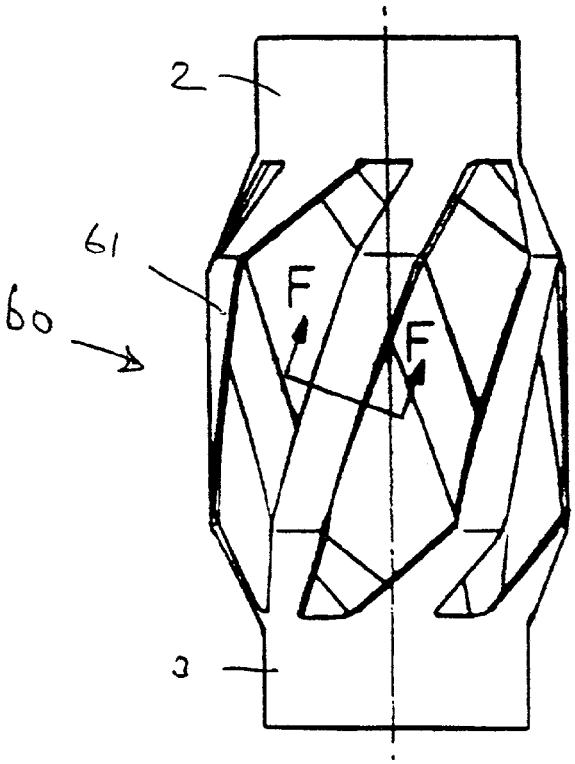
FIG. 23 is a side elevation of a spring centraliser in accordance with a fifth embodiment of the invention, having spirally-formed spring portions.

The embodiment of FIG. 21 may be used to bridge grooves in the borehole left after a drilling operation, scrape the borehole surface free of accumulated surface contaminants and present an angle of shear against the surface of the borehole when running in. A rigid version of the embodiment of FIG. 21 is shown in FIG. 23. In this embodiment the centraliser 60 has generally spiral bow members 61, somewhat similar to those shown in FIG. 21, but with straight line segments similar to those described with respect to FIGS. 17 and 18. FIGS. 24 and 25 show preferred selected forms of the cross-section of the bow portions 61. In both cases the material of the bow portion is curved inwardly so to lie on the cylinder defined by the inner surfaces of the collar members 2, 3. In FIG. 24, the form of bow element is generally rectangular, whereas that shown in FIG. 25 is generally semi-circular. The effect of both is that the bow portions will lie on an inserted tubular to provide enhanced resistance to collapse.

Figure 26:
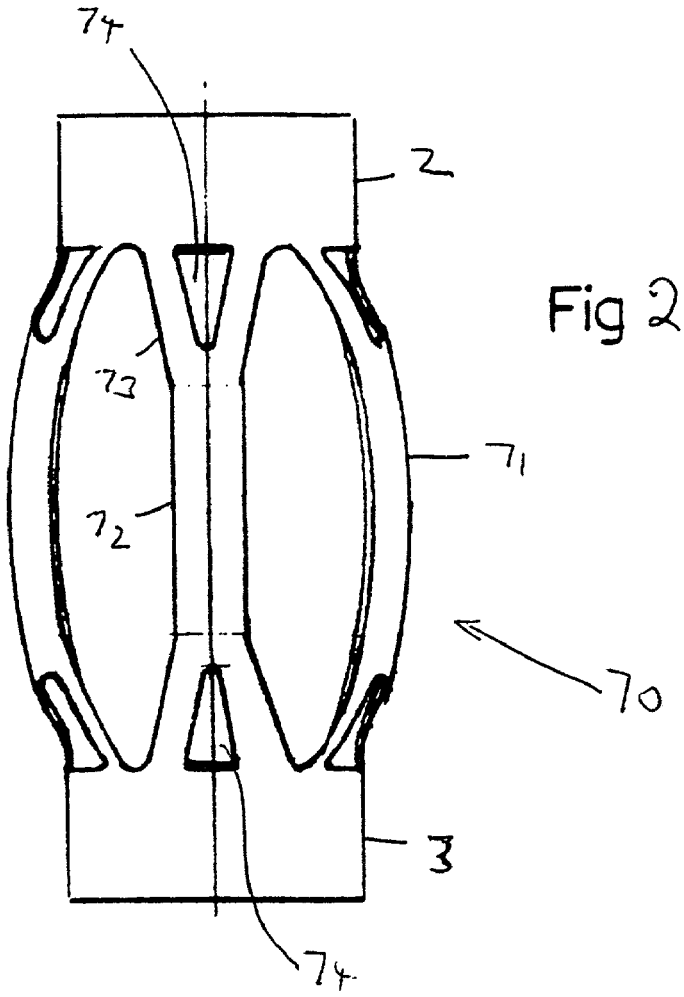
FIG. 26 is a side elevation of a further embodiment of a centraliser in accordance with the invention having apertures for increased fluid flow.

Referring now to FIG. 26, yet a further embodiment of a centraliser in accordance with the invention is shown. This centraliser 70 has bow portions 71 which have a longitudinally central region 72 of constant width which extends at each end into a Y shaped bifurcation 73. The bifurcations extend into the top collar member 2 or respectively bottom collar member 3. Each bifurcation defines an aperture 74 forming an isosceles triangle in this particular embodiment. The aperture allows fluid passing through the annulus between the tubular and the borehole to also flow along the underside of the bow member. Hence centralisers having such apertures may be used where reduced flow resistance is needed. It will be understood by those skilled in the art that the particular choice of a triangular aperture 74 is only exemplary and other shapes could be provided.

Figure 27:
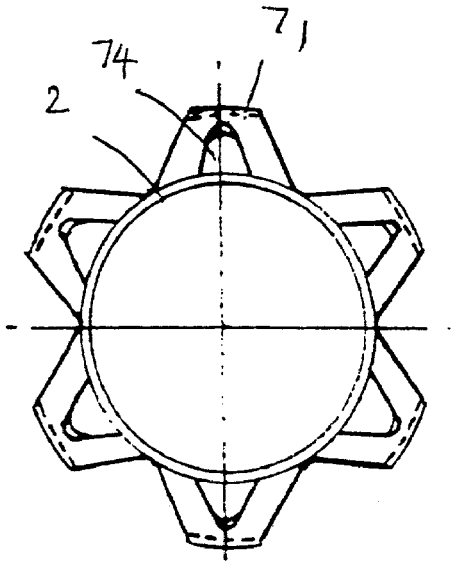
FIG. 27 is an end view of the centraliser of FIG. 26.

Referring to FIG. 27, the end elevation shows more clearly the provision of the apertures, which allow for reduced flow resistance. It would be understood by those skilled in the art that with increased reach of wells the flow resistance is desirably reduced. As flow resistance increases, pressure must be raised to deliver the same flow rate and the increased pressure may lead to break down of geological formations.

The embodiments described so far have been unitary structures. It is, however, known to those skilled in the art that split form centralisers of two halves separated along an axial center line will be required. It will also be known to those skilled in the art that centralisers having more than two segments will be required.

FIGS. 28 and 29 show a first securing formation for securing together segments of a centraliser.

Referring to FIG. 28 which is a partial end view of a centraliser, the end collar 2 is formed of two semi-cylindrical end collar portions 2A, 2B which are secured together by a snap-lock securing device.

Referring to FIG. 29, an example of the snap-lock devices shown. The end portion of one end collar portion 2A is longitudinally cut to form three contiguous finger portions 100, 101, 102. The central finger portion 101 is raised out of the plane of the collar portion 2A and has two windows 103 cut into it, the windows having a curved profile in their extremities nearest to the end of the collar portion 2A. The two outer finger portions 100, 102 are arcuately cut to define two tongue portions 104 which are displaced upwardly from the plane of the collar portion 2A. The form of the tongue portions 104 is arcuate.

The other end collar portion 2B is also cut to form three counterpart finger portions 200, 201, 202. In this case, the two outer fingers 200, 202 are raised out of the plane of the end collar portion 2B and are provided with windows 203 of similar shape to windows 103 and the central finger 201 is provided with two upwardly-disposed tongue portions 204 of similar shape to the tongue portions 104.

When the two collar portions 2A, 2B are urged together, the central tongue portion 101 of the first collar portion is able to ride over the upper surface of the central finger 201 of the second collar portion 2B while the outer finger portions 200, 202 ride over the outer fingers 100, 102 of the first collar portion 2A. The disposition of the tongues 104, 204 and the windows 103, 203 is such that the tongues enter the counterpart windows to form-lock the two collar portions together.

Use of boron steel with the end collar portions being heat-treated to provide high stiffness collar portions enables the snap-lock securing device to readily and safely secure together the two halves of the device. An advantage of such a configuration is that for a two-half centraliser, only two components are required. This is in contrast to arrangements where hinge pins and other securing devices may be required. It will be understood by those skilled in the art that the fewer components that are provided, the less risk there is of components becoming detached and falling into the borehole with high remedial costs.

Figure 30:
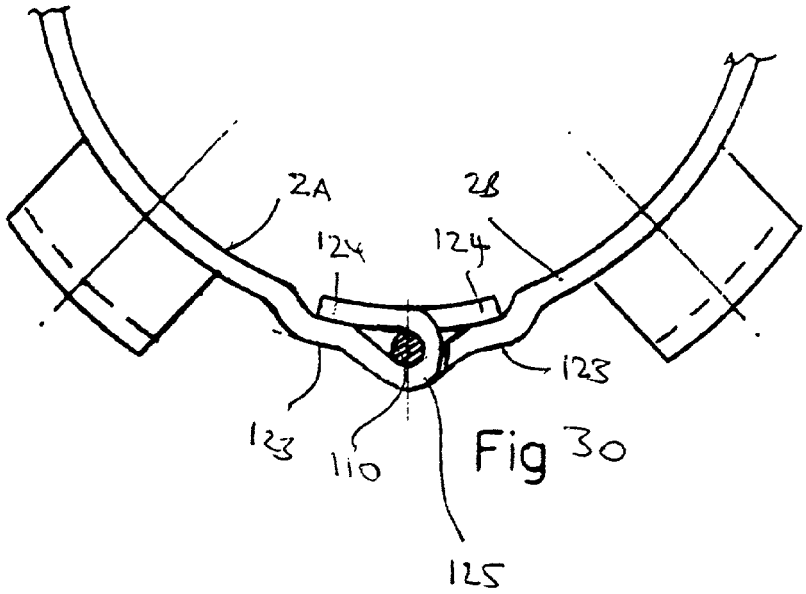
FIG. 30 shows a partial end view of a two-part centraliser, having a hinged connection device.
Figure 31:
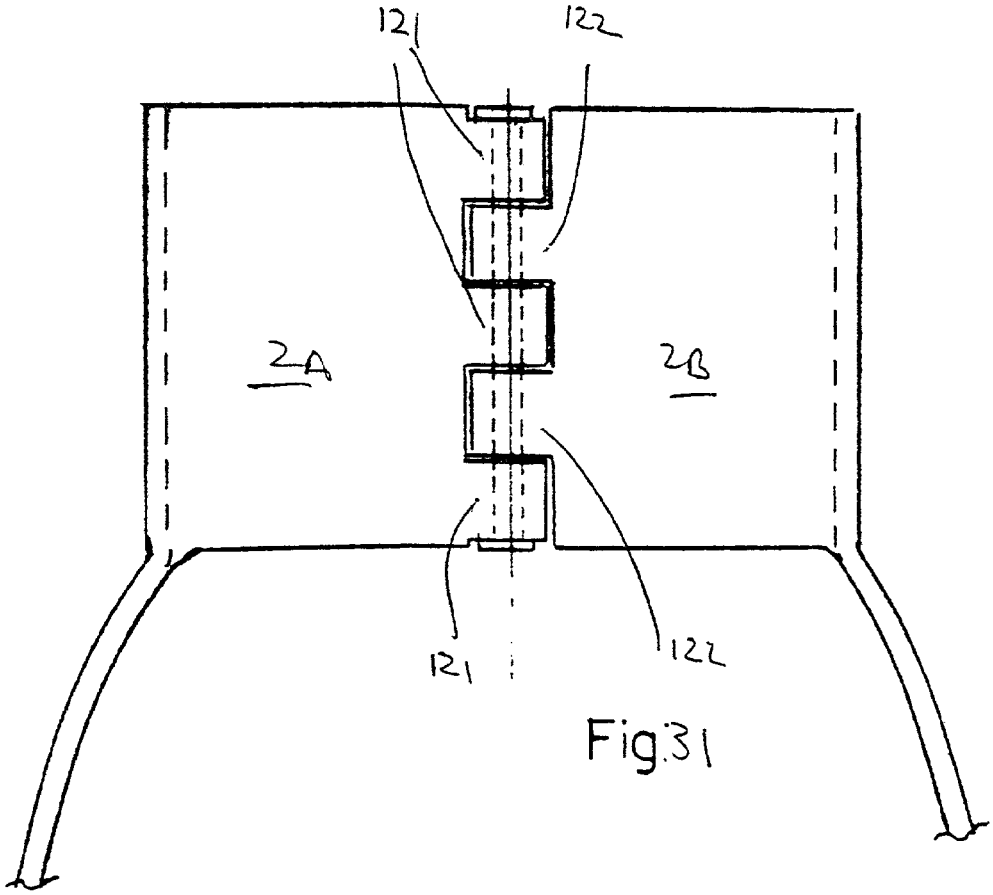
FIG. 31 shows a partial side elevation of the centraliser of FIG. 30.

FIG. 30 shows an alternative embodiment in which the free ends of the collar portions are turned to form a hinge, having an hinge pin 110. Reference to FIG. 31, shows that the first end collar portion 2A is cut to have three spaced finger portions 121 and that the second end collar portion 2B is cut to have two spaced finger portions 122. The disposition of the finger portions 121 and 122 is such that a finger portion 121 may be interdigitated between the finger portions 121. The finger portions have a proximal region 123 which extends outwardly from the respective end collar 2A, 2B. A distal portion 124 which lies against a face of the proximal portion 123, and an intermediate hooked portion 125 whose inner face defines an aperture for the hinge pin.

In use the hinge is assembled by interdigitating the finger portions, the hinge pin is inserted, and the assembly offered up to the tubular. The opened assembly is then closed around the tubular, and a second hinge pin inserted into the second hinge. The ends of the hinge pins are deformed e.g. by peening over, to retained them in place.

Figure 32:
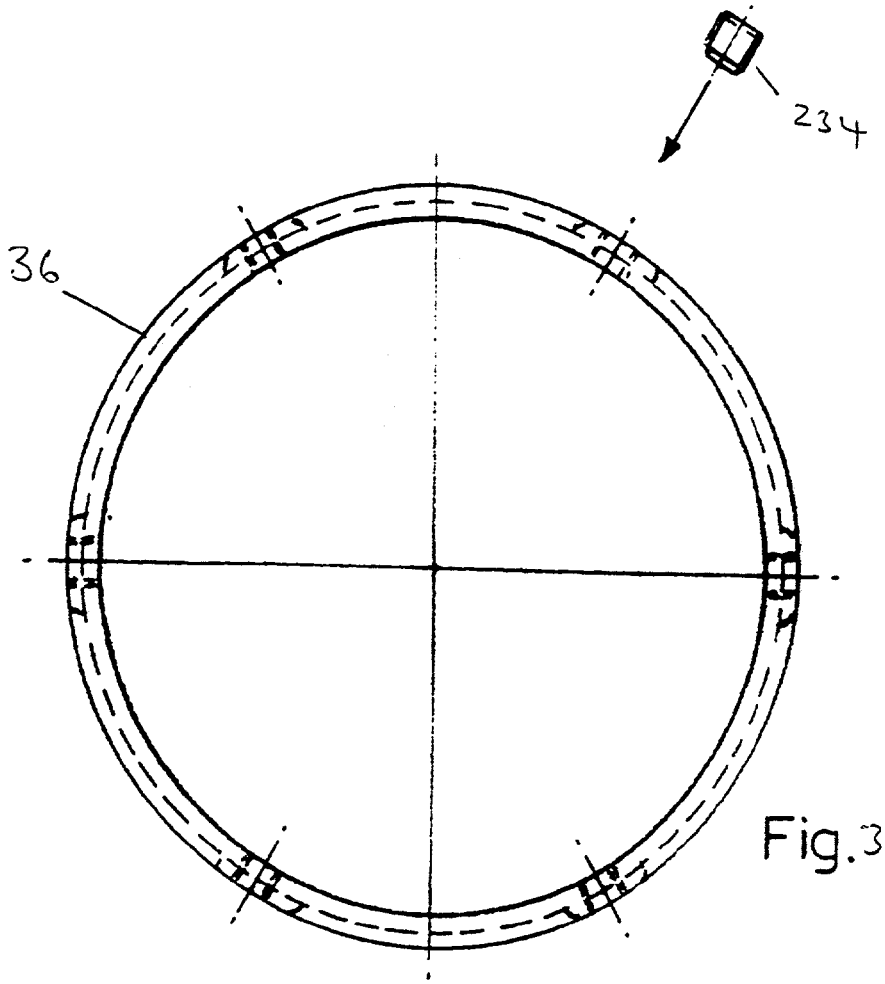
FIG. 32 shows an end view of a stop collar for use with centralisers of the invention.
Figure 33:
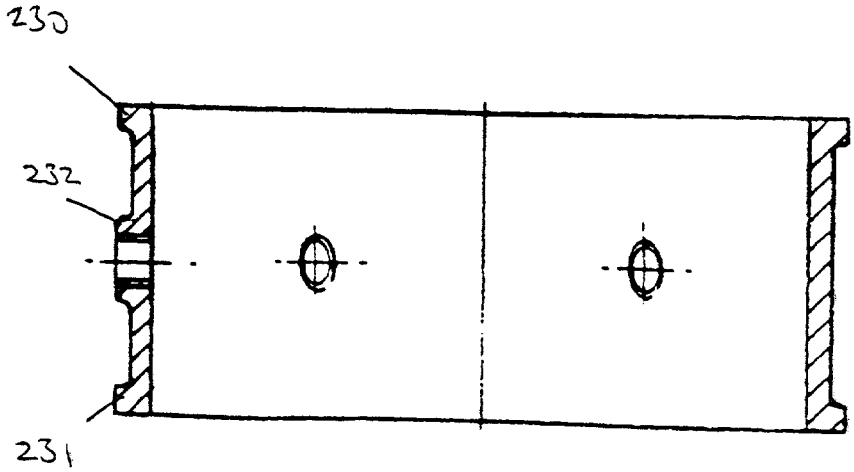
FIG. 33 shows a side elevation of the stop collar of FIG. 32.

Referring now to FIGS. 32 and 33, a slip-on stop collar 37 consists of a generally cylindrical body of boron steel having circular top and bottom flange portions 230, 231 extending outwardly and a number of boss portions 232 disposed around the circumference of a central region of the collar to accept grub screws 234.

Traditionally stop collars are manufactured from rolled rectangular bar section with the ends being butt-welded to form a ring. The material must be suitable for welding as the action of the screws against an inserted tubular can cause substantial circumferential loading at the weld joint. Other known products are made from seamless steel tube, but there are limitations as to available size and material grade.

By selecting boron steel, it is possible to achieve 98% of the mechanical properties of the parent material across a welded zone.

FIG. 33 clearly shows the end flanges, which are produced by swaging. The swaging is performed in the un-heat-treated state of the material and the boss portions 232 are formed by known flow drilling techniques. After the device has been suitably formed, it is then heat-treated and quenched to obtain the desired properties.

The invention claimed is:

1. A method of making a spring centraliser device having a longitudinal axis, the method comprising:

from a sheet of boron steel, producing a flat blank comprising a first and a second transverse web portion spaced apart by plural spaced longitudinal web portions;

cold-forming said blank to form a shaped intermediate product having a desired final device shape; and heating and quenching said shaped intermediate product to a desired finish hardness, wherein said first and second transverse web portions extend to form free end portions, and wherein said cold-forming comprises forming said free end portions into securing devices for securing said spring centraliser device to a second spring centraliser device.

2. The method of claim 1, wherein said producing step comprises laser cutting the sheet of boron steel.

3. The method of claim 1, wherein said producing step comprises water-jet cutting of the sheet of boron steel.

4. The method of claim 1, wherein said spring centraliser device is substantially semi-cylindrical, whereby said first and second transverse web portions form substantially semi-cylindrical collar portions and wherein said collar portions have the formed securing devices for securing to collar portions of said second spring centraliser device to form a substantially cylindrical spring centralizer.

5. The method of claim 4, wherein said step of forming securing devices comprises forming a hooked portion of each said collar portion.

6. The method of claim 5, wherein after said heating and quenching step the method further comprises disposing a hinge pin in abutment with the hooked portions of two contiguous spring centraliser devices to thereby hingedly secure the spring centraliser devices together.

7. The method of claim 4, wherein said step of forming said securing devices comprises forming at one securing region of said spring centraliser device, at least one first region projection from a first face thereof, and at least one first region aperture in a second face thereof, and forming at a second opposing securing region, at least one second region aperture in said second face thereof at a location for cooperating with the at least one first region projection and at least one second region projection in said first face thereof at a location for cooperating with the at least one first region aperture.

8. A spring centralizer device formed by the method of claim 4.

9. The method of claim 1, wherein said cold-forming step comprises forming said longitudinal web portions into bow portions having central regions relatively further from the longitudinal axis of said spring centraliser device than end regions of said bow portions.

10. The method of claim 9, wherein said bow forming step comprises forming said bow portions undersize, and further comprising, after said heating and quenching step, a further cold-forming step to form said bow portions to a desired final diameter.

11. A spring centralizer device formed by the method of claim 9.

12. A spring centralizer device formed by the method of claim 1.

13. The method of claim 1, wherein the securing devices are produced in the same cold-forming step used to form said shaped intermediate product.

14. A method of making a spring centraliser device having a longitudinal axis, the method comprising:

providing a sheet of boron steel;

producing from said sheet a flat blank comprising a first and a second transverse web portion spaced apart by plural spaced longitudinal web portions;

cold-forming said blank to form a shaped intermediate product having a desired final device shape; and heating and quenching said shaped intermediate product to a desired finish hardness, wherein said spring centraliser device is substantially semi-cylindrical, whereby said first and second transverse web portions form substantially semi-cylindrical collar portions and wherein said collar portions have securing devices for securing to collar portions of a second said spring centraliser device to form a substantially cylindrical spring centralizer, wherein said cold-forming step comprises forming at least part of said securing device.

15. The method of claim 14, wherein said step of forming said securing devices comprises forming a hooked portion of each said collar portion.

16. The method of claim 14, wherein after said heating and quenching step the method further comprises disposing a hinge pin in abutment with the hooked portions of two contiguous spring centraliser devices to thereby hingedly secure the spring centraliser devices together.

17. The method of claim 14, wherein said step of forming said securing devices comprises forming at one securing region of said spring centraliser device, at least one first region projection from a first face thereof, and at least one first region aperture in a second face thereof, and forming at a second opposing securing region, at least one second region aperture in said second face thereof at a location for cooperating with the at least one first region projection and at least one second region projection in said first face thereof at a location for cooperating with the at least one first region aperture.

18. A method of making a spring centraliser device having a longitudinal axis, the method comprising:

producing a sheet of boron steel;

producing from said sheet a flat blank comprising a first and a second transverse web portion spaced apart by plural spaced longitudinal web portions;

cold-forming said blank to form a shaped intermediate product having a desired final device shape; and heating and quenching said shaped intermediate product to a desired finish hardness, wherein said cold-forming step comprises forming said longitudinal web portions into bow portions having central regions relatively further from the longitudinal axis of said spring centraliser device than end regions of said bow portions;

wherein said bow forming step comprises forming said bow portions undersize, and further comprising, after said heating and quenching step, a further cold-forming step to form said bow portions to a desired final diameter.

* * * * *